US008472632B2

(12) United States Patent
Riedel et al.

(10) Patent No.: US 8,472,632 B2
(45) Date of Patent: Jun. 25, 2013

(54) DYNAMIC SWEET SPOT TRACKING

(75) Inventors: Matthias Riedel, Stuttgart (DE); Ernoe Kovacs, Stuttgart (DE); Amen Hamdan, Munich (DE)

(73) Assignee: Sony Deutschland GmbH, Berlin (DE)

( * ) Notice: Subject to any disclaimer, the term of this patent is extended or adjusted under 35 U.S.C. 154(b) by 1418 days.

(21) Appl. No.: 10/581,358

(22) PCT Filed: Dec. 13, 2004

(86) PCT No.: PCT/EP2004/014183

§ 371 (c)(1),
(2), (4) Date: Jun. 2, 2006

(87) PCT Pub. No.: WO2005/060308

PCT Pub. Date: Jun. 30, 2005

(65) Prior Publication Data

US 2007/0116306 A1 May 24, 2007

(30) Foreign Application Priority Data

Dec. 11, 2003 (EP) ..... 03028572
May 10, 2004 (EP) ..... 04011087

(51) Int. Cl.
*H04R 29/00* (2006.01)

(52) U.S. Cl.
USPC ..... 381/56; 381/303; 455/456.1; 340/539.13

(58) Field of Classification Search
USPC ..... 381/56, 57, 303, 300, 307, 58; 455/456.6; 340/359.13, 359.11
See application file for complete search history.

(56) References Cited

U.S. PATENT DOCUMENTS

| | | | | |
|---|---|---|---|---|
| 5,581,621 | A | 12/1996 | Koyama et al. | |
| 6,118,880 | A | 9/2000 | Kokkosoulis et al. | |
| 6,970,568 | B1 * | 11/2005 | Freeman et al. | 381/58 |
| 2002/0159611 | A1 * | 10/2002 | Cromer et al. | 381/303 |
| 2003/0031333 | A1 * | 2/2003 | Cohen et al. | 381/303 |
| 2003/0130793 | A1 * | 7/2003 | Patwari et al. | 701/300 |

FOREIGN PATENT DOCUMENTS

| | | |
|---|---|---|
| DE | 43 07 490 | 9/1994 |
| JP | 6-165297 | 6/1994 |
| JP | 11-355899 | 12/1999 |

(Continued)

OTHER PUBLICATIONS

Priyantha, Nissanka B. et al.,"The Cricket Location-Support System", 6th ACM/IEEE International Conference on Mobile Computing and Networking, pp. 1-12, 2000.

(Continued)

*Primary Examiner* — Vivian Chin
*Assistant Examiner* — Con P Tran
(74) *Attorney, Agent, or Firm* — Oblon, Spivak, McClelland, Maier & Neustadt, L.L.P.

(57) ABSTRACT

An audio system with a dynamic sound field adaptation to follow a listeners position. The audio system includes a relative location determination mechanism for determining the relative positions of at least all sound emitting components of the audio system with respect to each other, a personal device detector for detecting a personal device belonging to a user, a personal device position tracking mechanism for tracking the position of the personal device, and a re-calibration mechanism for re-calibrating the sound field such that the sweet spot of the sound field is placed at the current position of the personal device.

13 Claims, 2 Drawing Sheets

FOREIGN PATENT DOCUMENTS

Figure 1:
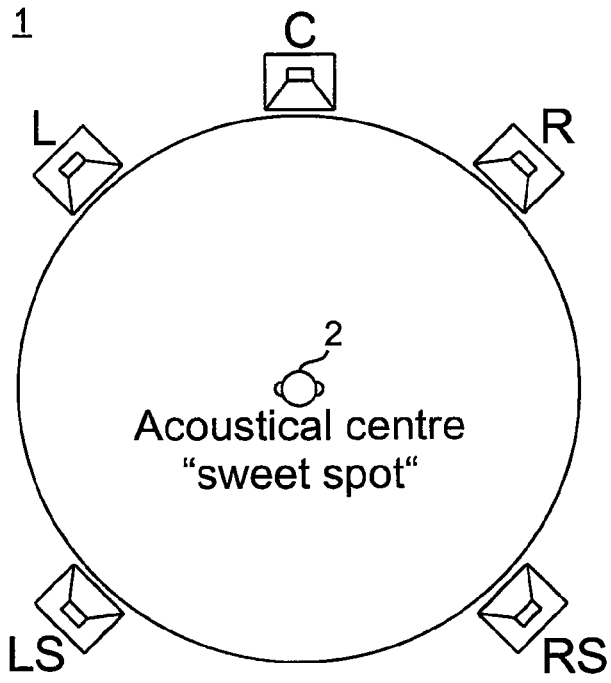

| | | | |
|---|---|---|---|
| JP | 2001-86600 | | 3/2001 |
| JP | 2001-321452 | | 11/2001 |
| JP | 2001-359200 | | 12/2001 |
| JP | 2002-112400 | | 4/2002 |
| WO | WO 01/93434 | A2 | 12/2001 |
| WO | WO 01/93434 | A3 | 12/2001 |
| WO | 03 055272 | | 7/2003 |

OTHER PUBLICATIONS

"Multichannel stereophonic sound system with and without accompanying picture" Document 6J/TEMP/10, Draft Revision of Recommendation ITU-R BS.775-1, International Telecommunication Union, Radiocommunication Study Groups, Apr. 5, 2006, 12 pages.

Günther Theile "Multichannel Natural Music Recording Based on Psychoacoustic Principles/[1]" Extended version of the paper presented at the AES 19$^{th}$ International Conference, May 2001, Oct. 2001, 45 pages.

"Listening Conditions and Reproduction Arrangements for Multichannel Stereophony", Surround Sound Forum, Recommended Practice SSF-01.1-E-2002, SSF-01.1-2000, 25 pages.

Andreas Savvides, et al., "Dynamic Fine-Grained Localization in Ad-Hoc Networks of Sensors", 2001, pp. 166-179.

Cliff Randell, et al., "Personal Position Measurement Using Dead Reckoning", 2003 IEEE, pp. 166-175.

Srdjan Capkun, et al., "GPS-free Positioning in Mobile Ad Hoc Networks", Cluster Computing 5, 2002, pp. 157-167.

* cited by examiner

DYNAMIC SWEET SPOT TRACKING

The present invention relates to a sound system with automatic sweet spot tracking based on a listener's position within a listening room. In particular, the present invention relates to a dynamically adaptable multichannel stereophony sound system with wireless communication means.

Multichannel stereophony sound like surround sound originated in cinemas has successfully made its way into the homes of many consumers in entertainment systems. Many current home entertainment systems are equipped with a TV, DVD player and a 5.1 surround sound system basically composed of 5 satellite speakers and a subwoofer. Nowadays it is standard for television, film and many DVD titles to have a surround sound track encoded in one of the common formats. It is even expected that more complex loudspeaker configurations (6.1, 7. 1) will be available on the market.

Speaker, room and the point of listening interactions have a huge impact on the sound field of the music system. The overall listening conditions of an audio system and the achievable quality of the sound field created by it are primarily determined by the geometric and acoustical properties of the listening room, the properties and arrangement of the loudspeakers used within the listening room, and the listening position, or rather the listening zone, for the selected listening places. The digital surround sound receivers, preamps or processors must therefore be configured properly to achieve an optimal listening experience. The term 'listening conditions' defines the complex characteristics of a 'sound field' that a listener in a listening room at the reference listening position is subjected to by the room-related reproduction of sound over loudspeakers. Details are e.g. explained in "Listening Conditions and Reproduction Arrangements for Multichannel Stereophony, Recommended Practice SSF, 01.1-E-2002, Surround Sound Forum 2002". A sound field describes the spatial distribution of an acoustic wave or sound wave, respectively, or of more than one acoustic wave superposing each other.

In order to obtain the optimal listening experience with home reproduction it is necessary to calibrate the audio system or sound system, respectively, in the listening room at the reference position at the height of a listener's ears. FIG. 1 shows an arrangement example under home conditions where all speakers of a surround system are set-up in a circular arrangement around an acoustical centre. The optimum listening position, the so-called sweet spot should mirror the vantage point of the recording or mixing engineers position, respectively. A sweet spot is defined as the location, where the propagation times of the reproduced channels from the speakers to the listener are principally identical. All channel sources must arrive at the sweet spot at the same time. In an ideal undisturbed environment this is the position, which is equidistant to all main loudspeakers, which means that all speakers should be placed at the same distance from the listening position.

This ideal positioning illustrated in FIG. 1 is usually not applicable for most home situations. It is assumed that the "normal" home sweet spot area is approximately a 1,5 m square. Inside this area the stereophonic quality of the surround sound recording should be sufficiently stable. Further details regarding this issue are e.g. given in "Multichannel Natural Music Recording Based on Psychoacoustic Principles, Günther Theile, October 2001". But for a precise surround imaging, the sound system has to be calibrated in a home scenario.

When optimising the arrangement of loudspeakers from a sound system under home conditions the loudspeakers have deviations from the hypothetical circular line shown in FIG. 1. To compensate these deviations all speakers may need additional and differentiated level and delay compensations.

Nowadays systems offer independent change of balance, centre level, side levels, rear levels, and subwoofer level to shift the position of the stereo image towards the reference position at the height of the listener's ears. To fine tune the speakers according to their type and to guide the user through the calibration procedure, many sound systems offer a test tone helping to calibrate the volume levels. As one example, common consumer Dolby Digital (AC-3) or Pro Logic units provide a built-in test signal generator called noise sequencer to balance all channels. When activating the sequencer a brief, specially filtered noise signal to each channel in turn is send out. As the test signal "travels" from channel to channel, the user has to adjust the balance of each channel individually at the same apparent loudness at the actual listening position.

Many sound systems offer a delay compensation to set the appropriate time delay for ensuring, that all channel sounds reach the listener's ears at the correct time to aid proper imaging and localisation. In most units this is accomplished by selecting the distance from the listening position to each speaker via an on-screen display or the user must select the amount of delay in milliseconds. As one example common consumer Dolby Surround decoders allow manipulating the time delay from 15 to 30 ms, allowing to compensate for being seated unusually close to or far from the surround speakers.

A recommended time delay formula, states: $T=Nd+Df-Ds$, where T is the delay setting, Nd is the net delay time in milliseconds (Dolby recommends 15 ms), Df is the distance from the listener to the nearest front speaker, and Ds is the distance from the listener to the nearest surround speaker.

A so-called 'home processor' has the capability to process the necessary corrections by the use of measuring impulses.

Within the Bang & Olufsen BeoLab 5 sound system a moving microphone system measures and analyses reflections in the room with the help of an adaptive Bass Control, and adapts them to the bass unit's performance. Although, in general, bass reproduction is particularly sensitive to a loudspeaker's position, this is not the case with BeoLab 5 due to the "Acoustic Lens Technology" that is licensed from Sausalito Audio Works LLC. By pressing a button at the top of the loudspeaker, it calibrates and adapts to the surroundings within two minutes. BeoLab 5 is a digital loudspeaker where the signals inside the loudspeaker are processed digitally until they are amplified and emitted by the speaker units. The heart of the signal processing is the so-called Digital Signal Processor, which handles cross-over, volume adjustment and Adaptive Bass Control. Although the system allows to compensate for acoustically relevant peculiarities in the listening room, the audio calibration achieved is static.

But a user may not always stay in the optimum position, i.e. within the sweet spot of the audio system. When staying in a different location, the sound system will have to be re-calibrated to shift the sweet spot to the position of the user.

MSB Technology provides a calibration method for an audio system that allows setting the sweet spot according to a user preference. The Multiple Volume Control of the system features discrete volume control over eight channels. The MVC comes with a microphone for automatic level setting. This feature allows the user to automatically calibrate all speaker level settings for any listening position by placing the microphone at that location. When the microphone is plugged in and the user presses the Setup button, pink noise will sound from each of the speakers in sequence. The signal will start at a low volume and increase until the sound reaching the microphone registers at the designated level. At this point that speaker's setting is established and the next speaker in the sequence begins the process. For a different position of a listener a new calibration of the sound systems audio characteristic is required.

A more versatile re-calibration is provided by the PDSP-1 (Pioneer Digital Sound Projector) system from Pioneer. It enables the reproduction of multi-channel surround sound through an integrated, one-panel active speaker system. It produces surround sound by controlling separate beams of sound. Sound beams for each audio channel are reflected off the walls and ceiling of the room to replace the left, right and rear speakers. 254 individually driven speaker units are combined into a one-panel loudspeaker array. The sound is delivered in up to seven separate beams—matching the source—that can be steered, as well as controlled to become a focused or wider beam. Through reflection off the ceiling and/or walls, multi-channel surround sound reaches the listener's position. This loudspeaker technology removes the need for multiple conventional loudspeakers and associated wiring. The PDSP-1 uses digital signal processing to equalise the sound according to the characteristics of the room, and allows users to store multiple settings corresponding to different listening conditions or user preferences.

But a very frequent problem in a home scenario like that illustrated in FIG. 1 is that a user changes her or his listening position resulting in moving out of the reference position defined by the acoustic centre indicated. In order to retain the optimal listening experience a re-calibration of the sound system may be necessary. Most users would not accept the effort associated with such manual short-term system re-calibrations.

Using a digital surround headphone system, like the Sony NMR-DS5000, provides a solution to the problem. This system uses headphones to create a multi-channel surround field equivalent to a live performance. This system consists of a digital surround processor, which contains a surround decoder, a Logic 3D processor, an infrared transmitter and a pair of infrared cordless headphones. The surround decoder is capable of both digital and pro logic modes. After the signal is decoded into multiple channels by the surround decoder it is subjected to a multi-channel to binaural conversion by the Logic 3D processor without losing any of the multi-channel information. When the processed signal is played through the supplied headphones, the multi-channel sound field is reproduced with the sound image positioned outside of the listener's head. A major drawback of this system is, that it requires the listener to wear the headphones for gaining the optimum listening experience.

It is therefore an object of the present invention to provide an audio system, which ensures an optimum listening experience for a person changing its position within the listening room of the audio system.

This object is achieved by an audio system as defined in the independent claim.

The respective audio system provides a dynamic sound field adaptation to follow a listener's position. It comprises a relative location determination means for determining the relative positions of at least all sound emitting components of the audio system with respect to each other, a personal device detection means for detecting a personal device belonging to a user, a personal device position tracking means for tracking the position of the personal device, and a re-calibration means for re-calibrating the sound field such, that the sweet spot of the sound field is placed at the current position of the personal device without any user interaction.

The present invention optimises the listening experience by providing a dynamic sound field adaptation based on a position determination of an appliance acting as a personal item of a listener. It thus overcomes the problem of a manual sound system re-calibration.

Further embodiments of the invention are the subject of the respective sub-claims.

An effective sweet spot tracking is achieved by adapting each of the relative location determination means, the personal device detection means, the personal device position tracking means, and the re-calibration means for communicating via a network. Hereby the network is advantageously at least partly implemented in form of a wireless communication network and/or at least partly implemented in form of a wired communication network.

To solve the problem of a multi-listener audience and/or of several personal devices detected for one user, the audio system further advantageously comprises an arbitration means for arbitrating between different requirements set by more than one personal device being detected by the personal device detection means according to a set of criteria. One of the preferred criteria is hereby to position the sweet spot for covering a maximum number personal device positions as tracked by the personal device position tracking means. Another one of the preferred criteria is to position the sweet spot to a position of a preferred personal device as tracked by the personal device position tracking means.

To keep a user of the audio system informed about the actual status, the audio system may advantageously comprise a position display for displaying the positions of the sound emitting components and/or the position of each personal device detected, and/or the position of the current sweet spot.

To allow a user to change between automatic and static sweet spot positioning, the audio system comprises a mode switching means for switching at least between a mode where the sweet spot follows a listener and a mode where the sweet spot is kept in a fixed position.

Figure 2:
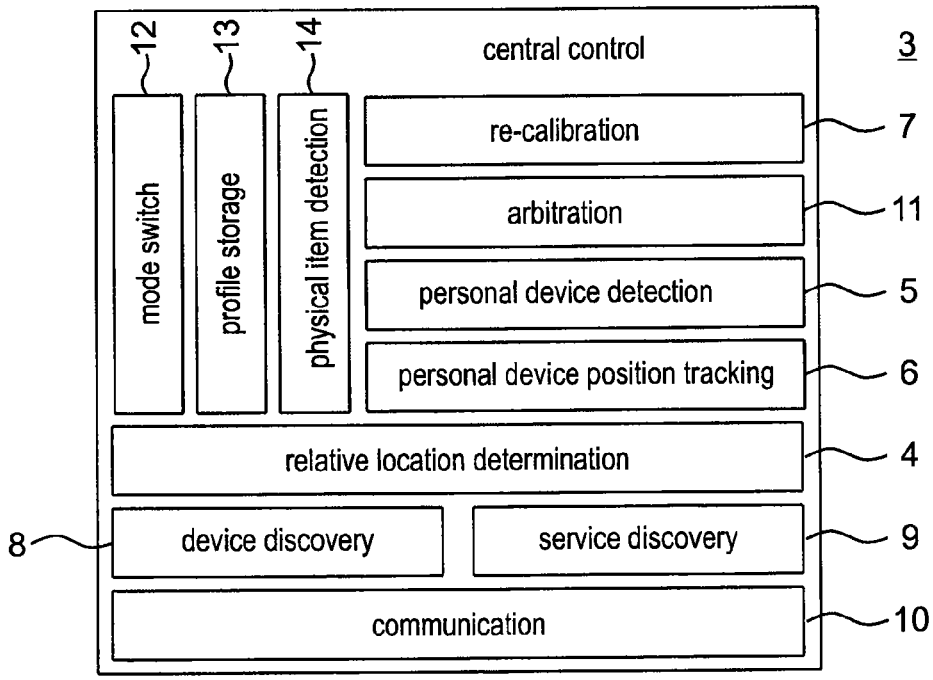
Figure 3:
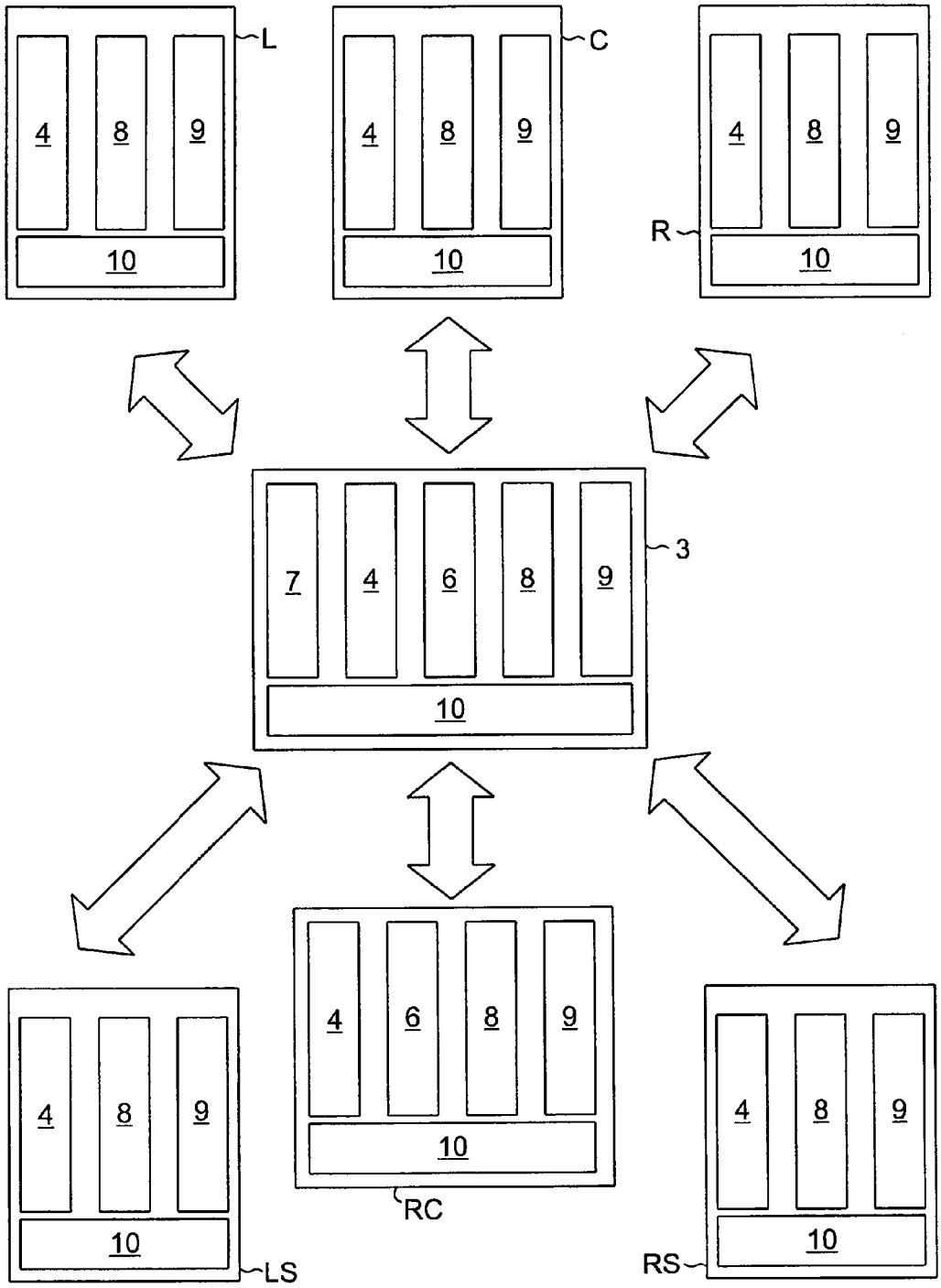

In the following description, the present invention is explained in more detail with respect to special embodiments and in relation to the enclosed drawings, in which FIG. 1 shows a loudspeaker arrangement for use with an audio system according to the present invention, FIG. 2 is a block diagram showing the building blocks of a device for an audio system according to the present invention, and FIG. 3 is a schematic view of an audio system according to the present invention and its components.

In the drawings, functionally equivalent elements are assigned equal reference numerals.

The representation of FIG. 1 illustrates the basic problem underlying the present invention. The audio sources, like e.g. loudspeakers of a multi-channel sound system like for instance a stereo set or a surround system are positioned in a certain geometrical arrangement. An audio signal, which is simultaneously emitted by all loudspeakers, arrives at the acoustic centre of the arrangement within the same time period. If the loudspeakers with the same phase and without any delay emit the acoustic signal, the acoustical centre also represents the sweet spot. FIG. 1 shows a surround system consisting of five main loudspeaker, namely the left front speaker L, the right front speaker R, the centre speaker C, the left surround speaker LS, and the right surround speaker RS. A listener 2 is positioned in the geometrical centre of the arrangement 1.

The block diagram of FIG. 2 shows the required and optional components of an audio system I according to the present invention. A respective audio system provides a dynamic multi-channel adaptation, i.e. it is adapted to monitor a listener's position and to automatically track the sweet spot of the system in correspondence to the position monitored. Not all components are required in each physical unit of the audio system 1. Usually one preferred unit, like for instance a central control unit 3 which may be integrated with the amplifier of an audio system 1, is assigned to perform the dynamic multi-channel adaptation and may thus contains the components shown. But also an arrangement where the single components shown in FIG. 2 are distributed over the various units (L, C, R, LS, RS, RC, 3) of the audio system is possible.

The interconnection medium represented by the communication means 10 is the interface through which the different units (L, C, R, LS, RS, RC, 3) of the audio system 1, like e.g. the stereophony sound system of FIG. 1, can communicate with each other. Through the communication means 1 formed in each unit of the system, any other unit can access the functionalities provided on each unit. The communication means 1 is thus responsible for the distribution of information which represents a current context of the audio system 1, like e.g. a context represented by data describing relative positions combined with device, service and status information. The communication may be implemented based on wired and/or wireless communication technologies.

In a preferred embodiment, each device within the sound system 1 includes a wireless communication means 1 with multi-hop and ad-hoc capabilities designed for operation in a home environment and for personal usage scenarios. An ad-hoc network is hereby understood as a local area network (LAN), especially one with wireless or temporary plug-in connections, in which some of the network devices are part of the network only for the duration of a communication session or, in the case of mobile or portable devices, while in some close proximity to the rest of the network. In a multi-hop wireless network a packet may have to traverse multiple consecutive wireless links in order to reach its destination. The topology of a multi-hop wireless network is the set of communication links between node pairs.

Two or more communication means 10 are forming an ad-hoc communication network where the administration data is either stored centralised within only one active node, i.e. a unit of the sound system 1, or distributed. Each communication means 10 has the capability to join or leave the communication network via self-configuration. Therefore no user interaction is necessary for the network administration. Preferably, each physically distinguishable unit belonging to the sound system 1 is pre-configured by default to announce its membership attributes. The data representing these membership attributes are used during the initiation or reconfiguration phase to identify each unit (L, C, R, LS, RS, RC, 3) belonging to the sound system 1. It is to be noted, that there is no limitation to add or remove devices, i.e. units (L, C, R, LS, RS, RC, 3) out of the logical group of devices forming a specific sound system 1. If one unit fails for example, this unit will be replaced by a new one with the proper membership attributes to take over its function.

For accessing each other's functionalities, a device discovery means 8 and, if a unit contains a set of services, a service discovery means 9 corresponding to each functional component of the unit are required. The device discovery means 8 offers a device lookup service that is capable of announcing, discovering and identifying a device. Service discovery enables disparate devices to communicate their functional capabilities to each other, while also providing the requester and the located service a means for entering into a relationship. A service discovery means 9 is capable to communicate their functional capabilities associated with the device. It may also offer status information like device activated, deactivated plugged or unplugged.

A respective service discovery may e.g. be based on a HAVi (Home Audio Video Interoperability) architecture, which is currently supported by eight manufacturers of audio-visual electronics and is intended for implementation on consumer electronic devices and computing devices. It provides a set of services that facilitate interoperability and the development of distributed applications on home networks. The HAVi architecture is a software architecture that allows new devices to be integrated into a home network and to offer their respective services in an open and seamless manner. The HAVi architecture provides an addressing scheme and lookup service for devices and their resources. The HAVi architecture focuses on a design for a common communication platform within the scope of consumer electronic devices and computing devices.

As an example, a service running on a remote control RC indicates that this unit is used as a personal device or that the device discovery exposes the personal device property to others.

The audio system 1 further includes a relative location determination means 4, providing a dynamic measurement of distances between the respective physical system units (L, C, R, LS, RS, RC, 3). Each physical unit (L, C, R, LS, RS, RC, 3) belonging to the sound system 1, like for instance loud speakers (L, C, R, LS, RS), amplifier 3, or a remote control RC, is capable to process peer-to-peer physical distance measurements. Ideally these distance measurements are carried out based on parameters inherent to the communication between the devices or units, respectively, e.g. based on measuring the signal strength or using some pulses for distance detection. Based on these peer-to-peer range measurement results, a distributed or centralised location determination algorithm computes the relative positions to the neighbouring units, regardless of an absolute co-ordinate knowledge. The final result is an accurate map of the surrounding of the unit enabling a precise positioning of the sweet spot according to any specification.

For an optimum listening experience, the sweet spot has to be put at a listener's position even when the listener is moving around. This is achieved by identifying a listener followed by tracking the identified listener. The basic idea behind associating a user defined preferably wireless personal device with the position of a listener is to generate a reference position to where the sweet spot of the stereo image has to be shifted. Due to the preferably wireless communication means 10 of each piece of equipment and the system capability of real-time position tracking and automated re-calibration, a listener will always retain the optimal listening experience at his actual position. In principle, each device which offers a service and device discovery like mentioned above within meaningful physical dimensions is to be understood as a portable device that can take on the role of a personal device.

A tracking system uses distributed tracking stations, which are suited to detect a personal device and to measure its respective position. Current mobile phone networks for instance provide a tracking system by means of their base stations, which is capable of pinpointing the geo-location of a mobile phone with an accuracy of less than hundred meters. Although the current preciseness of a respective positioning system is still too rough for a sweet spot tracking system, the technology behind it provides a suitable position and tracking technology. A more promising position determination technology is available with short-range wireless networks like WLAN (Wireless Local Area Network) or Bluetooth, but the most precise location technology presently available is the UWB (Ultra Wide Band) communication technology which allows to measure the distance between a mobile terminal and an access point with an accuracy of down to a few centimetres. The Cricket and the Spot-On System are e.g. two tracking systems, which provide a position determination that sufficient for the present invention. The Cricket system is described by Nissanka B. Priyantha, Anit Chakraborty, and Hari Balakrishnan in "The Cricket Location-Support System, Proceedings of the Sixth Annual ACM International Conference on Mobile Computing and Networking (MOBICOM), August 2000". The Spot-On system is presented by Jeffrey Hightower, Roy Want, and Gaetano Borriello in "SpotOn: An Indoor 3D Location Sensing Technology Based on RF Signal Strength, UW CSE 2000-02-02, University of Washington, Seattle, Wash., February 2000".

A mobile terminal is e.g. capable of determining its position by measuring external signals as e.g. those received from different base stations and of calculating its own position based on these. An outdoor GPS (Global Positioning System) is a well-known example for this. Indoor position mechanism typically use beacons or access point determination. Examples for respective systems that calculate a position based on a distance between a number of nodes are the Ad-Hoc Localisation system (Andreas Savvides, Chih-Chieh Han, Mani Strivastava: Dynamic Fine-Grained Localization in Ad-Hoc Networks of Sensors, Proceedings of ACM SIGMOBILE 7/01, pp. 166-179, 2001) and the Self-Positioning Algorithm (Srdan Capkun, Maher Hamdi, Jean-Pierre Hubaux, GPS-free positioning in mobile Ad-Hoc networks, Proceedings of the $34^{th}$ Hawaii International Conference on System Sciences-2001, 2001).

The identification of a listener is achieved by identifying a device that belongs to the listener. The capability of identifying such personal devices is embodied in a personal device detection means 5. This personal device detection means 5 may utilise various different means to detect personal devices. One possible mean is to identify moving devices. In this case, the position data is being checked periodically and the moving object identified. The result can be refined with classifying the type of devices that move, and assigning a likelihood level. Another possible means is that a personal device identifies itself as belonging to a user and is moving with the user.

In a household, there might be different types of mobile devices. Remote controls e.g. are devices that are usually shared by a number of people. Personal devices are devices that usually belong to only one dedicated user, like e.g. a mobile phone, a PDA (Personal Digital Assistant) or a Walkman. Determining therefore the type of the device already offers the possibility to decide if the device is a shared or a personal device. Since every rule has its exception, a more secure determination of a device being a personal one may be achieved by the device indicating its association to particular person. The device may for instance propagate its personal relationship by sending a broadcast signal (self-identifying personal device) or allow a retrieval of the respective information via its network functions. The identification of a personal device is more complicated if two or more possible candidates are detected within the same neighbourhood. The correct device may then be identified by a personal detection unit that compares each type of detected device with a list of known device types. The list contains a parameter indicating whether the device is to regarded as a personal device or not.

Another possibility is to identify moving devices. In this case, the position data is being checked periodically to identify a moving object. Many user carry more than just one device along with them, so that a listener can be identified by determining a group of devices that are close together and that are moving together. By combining the described personal device detection methods, a very reliable personal device identification is achieved. All personal devices that are present within the range at a time are preferably listed and the list is forwarded to other units of the sweet spot tracking system.

Once a personal device has been detected, a movement of the respective device is indicated and tracked by a personal device position tracking means 6 which provides the capability necessary for this. The matching of a personal device enables tracking the same objects through subsequent scans and therefore delivers a two-dimensional movement vector of each device. It may very well be the case, that the personal device is only detectable for a limited amount of time (i.e. because it switches off its communication media to save power as often as possible). As an advantageous feature in this case the tracking unit provides some extrapolation means to calculate the most probable position of the personal device even if it disappears for some time.

Based on the listener's current position determined, a recalibration means 7 provides a dynamic manipulation of the sound system settings to calculate a sound projection in relation to the transmitters (e.g. the loudspeaker) for bringing the sweet spot in line with the listener's current position.

A problem may arise, when more than one personal devices are detected within the sound irradiation space of the audio system 1, i.e. the listening room.

In case the system identifies several personal devices, it needs to take a decision on where to put the sweet spot. This arbitration is performed by an arbitration means 11. The arbitration means 11 hereto co-operate closely with the other components of the audio system 1, particularly with the personal device detection means 5, the personal device position tracking means 6, and the relative location determination means 4. The arbitration process is based on different input criteria, like e.g. the number of personal devices identified, the position of each of these personal devices, and the respective movement of each of these devices. The arbitration means 11 performs an optimisation based on the different input criteria, which may be one or a combination of the following:

a) put as much users as possible into the sweet spot, or
b) put preferred users into the sweet spot, e.g. based on the time each user had already spent in the sweet spot, or
c) put the sweet spot on the device which is most probably in the listeners current use, when more than on personal devices are identified for the same user,
d) other decision criteria by the arbitration means 11.

In case e.g., when several users with individual personal devices are joining a listening room, the one who was last to announce his device as reference personal device may be selected as the target tracking spot. This could either happen automatically or explicitly with user interaction e.g. pressing a specific button for to explicitly execute a confirmation process. A similar problem comes up when a user leaves the listening room with her or his personal device e.g., or detaches the personal devices status from her or his device, or even switches the device off. A satisfactory solution involves an automatic re-scan of the listening room, whereby the first detected personal device is selected as the reference point. In case no device is found at all, the last tracked user position or a virtual default position will be chosen for the sweet spot.

Items in the direct path between a listener and any of the surround speakers might influence the listening experience negatively. The same holds true for reflections generated by walls, floors or ceilings as the same sound would arrive at a listener twice. According to an advantageous development of the present invention, a physical item detection means 14 is adapted to detect items around the sound source with their physical characteristics like surface integrity or three dimensional designations and to utilise this information for changing the sound generation by the re-calibration means 7. The physical item detection means 14 can be implemented based on laser scanning, radar, infrared or audio detection methods or a combination of these.

Utilising laser scanning, a laser scans the surrounding and measures the distances. A built-in or a portable calibration unit may be used hereto. Radar based systems utilise the reflection of radio waves. Some modern communication means like e.g. Ultra-Wideband can provide modes for using the signal as a radar source. Using this approach, the detection feature can be advantageously included into the communication unit. Although not very precise, infrared means can be used to calculate some rough distances. As already described in the introductory section of this specification, also the reflection of audio signals can be used to analyse the surrounding.

A further enhancement of an audio system 1 according to the present invention is given by providing a profile storage 13 for storing preferred settings of the surround or stereophonic sound system for later recall by a user. In the simplest embodiment, the unit housing the profile storage 13 provides a button which, when pressed by a user transfers the settings to the profile storage 13. In another embodiment, a dedicated unit receives the settings from all other units and stores them in the profile storage 13 on command. The command is preferably initiated from a personal device when a user activates a respective function thereon by e.g. pressing a corresponding key or button.

In a further advantageous embodiment of the present invention a mode switch means 12 is provided, which allows a listener to switch between different modes of the surround system. Available modes may include Follow Mode, Static Mode or Main User Mode for instance. The Follow Mode represents the main mode of the sound system 1 according to the present invention, as it enables the system to track the sweet spot to a users position. The Static Mode is a secondary mode, that instructs the system 1 to keep the sweet spot at the current position. In the Main User Mode, the system keeps a list of main users with priorities and associated devices. The priority defines which user receives the sweet spot.

The co-operation of the different units of a sound system 1 according to the present invention is shown in FIG. 3. The acoustic emitters L, C, R, Ls, and RS or transmitters, respectively, are the same than in FIG. 1. Each of it is equipped in the example shown with a communication means 10, a relative location determination means 4, a device discovery means 8, and a service discovery means 9.

The sweet spot re-calibration is controlled by the amplifier unit 3 comprising a communication means 10, a re-calibration means 7, a relative location determination, means 4, a personal device position tracking means 6, a device discovery means 8, and a service discovery means 9.

A remote control RC serves as the personal device in the illustrated example. Besides a communication unit 10, it further contains a relative location determination means 4, a personal device tracking means 6 interacting with that of unit 3, a device discovery means 8, and a service discovery means 9.

In a more sophisticated system, a position display means can be used to display the position of devices and/or the position of assumed personal devices, and/or the position of the current sweet spot. Users can then use the available input means to move the sweet spot or to associate the sweet spot with a personal device. The position display means can further be enhanced with a map of the surrounding.

The present invention described provides a multi-channel stereophony sound system, which is capable of announcing, discovering and identifying the units forming the sound system under home conditions. It is further capable of announcing the services and their resources associated with each device forming the sound system, and of real time tracking the relative position of a listener by associating a personal device with the listener. In addition the present invention is capable of anchoring the sweet spot with the listeners location by re-calibrating the sound system settings dynamically and automatically based on a listeners position without any user interaction. The sound system presented is capable of forming a communication network via self-configuration. The necessary system data mining for the system calibration, distributed via wireless communication, has the capability of distinguishing the type of each interacting device, of dynamic and constant distance measurement, of computing relative positions and of movement detection.

The provided system is capable to process necessary delay compensations without user interaction for optimal listening experience based on the relative position of the listener to the devices creating a sound field . By utilising some of the additional modules, the system can detect and analyse the related physical parameters and compensate for interferences introduced by items in direct line or close to the speaker. The system is further adapted to store personal preferences and switch between different modes of usage.

It is to be noted that the technology underlying the present invention can be transferred to other tracking systems like an automatic angular alignment of a TV-screen or a monitor like e.g. a LCD-display. Particularly LCD-Displays used as TV or Computer monitors have a very narrow angle of optimum vision. In case that a user moves outside of the area defined by the angle of optimum vision, the image quality decreases significantly. By identifying and tracking a user of the display according to the present invention, the LCD-display can adapt its orientation automatically with a re-calibration means specialised for the LCD-display. The re-calibration of the angle of optimum vision can by carried out mechanically by pivoting the display or by an appropriate manipulation of the LCD units themselves.

In a videoconference system a respective display tracking system can be used to adjust the angle of optimum vision to each position of an individual. Instead of using a manual zoom, the system can determine the personal device positions and provide fast change of view angles based on these positions. This is basically the same invention as described with respect to the stereo surround system, but with a different calibration unit as it calibrates the view angle instead of the sweet spot and a position display unit that allows the users to select the view angles based on their positions.

The invention claimed is:

1. An audio system providing dynamic sound field adaptation to follow a listener position, the audio system comprising:

means for determining relative positions of at least one sound emitting component of the audio system with respect to other sound emitting components of the audio system using signal strength measurements communicated via a network;

means for detecting personal devices associated with at least one user;

means for real-time tracking of positions of the personal devices to produce a current position of each personal device; and means for re-calibrating a sound field to position a sweet spot of the sound field based on the current positions of the personal devices, wherein the means for determining, the means for detecting, the means for tracking, and the means for re-calibrating each further include means for communicating via the network.

2. The audio system according to claim 1, wherein the network comprises, at least in part, a wireless communication network.

3. The audio system according to claim 1, wherein that the network comprises, at least in part, a wired communication network.

4. The audio system according to claim 1, wherein the audio system includes physically-distinguished units, each physically-distinguished unit of the audio system includes means for announcing membership attribute data representing an identity of the physically-distinguished unit.

5. The audio system according to claim 1, further comprising:

means for arbitrating a location of the sweet spot among the current positions of the personal devices, according to a set of criteria.

6. The audio system according to claim 5, wherein the set of criteria includes criteria that positions the sweet spot for covering a maximum number of the personal devices.

7. The audio system according to claim 5, wherein the set of criteria includes criteria that positions the sweet spot to a preferred personal device of the personal devices.

8. The audio system according to claim 1, further comprising:

means for detecting acoustically interfering items that interfere with sound emitting components of the audio system.

9. The audio system according to claim 1, further comprising:

means for storing preferred settings of the audio system.

10. The audio system according to claim 1, further comprising:

display means for displaying positions of sound emitting components of the audio system, and/or the current position of the personal devices, and/or a position of the current sweet spot.

11. The audio system according to claim 1, further comprising:

means for switching between at least a mode in which the sweet spot follows a listener and a mode in which the sweet spot is kept in a fixed position.

12. The audio system according to claim 1, wherein the means for tracking further includes means for extrapolating a most probable position of the personal device.

13. An audio system providing dynamic sound field adaptation to follow a listener position, the audio system comprising:

a relative location determination unit configured to determine relative positions of at least one sound emitting component of the audio system with respect to other sound emitting components of the audio system using signal strength measurements communicated via a network;

a personal device detection unit configured to detect personal devices associated with at least one user;

a personal device position tracking unit configured to track, in real-time, positions of the personal devices to produce a current position of each personal device; and a re-calibration unit configured to re-calibrate a sound field to position a sweet spot of the sound field based on the current positions of the personal devices, wherein the relative location determination unit, the personal device detection unit, the personal device position tracking unit, and the re-calibration unit each further include a communication unit to communicate via the network.

* * * * *